US006842601B2

(12) United States Patent
Hosokawa

(10) Patent No.: US 6,842,601 B2
(45) Date of Patent: Jan. 11, 2005

(54) BELT TYPE IMAGE FORMING APPARATUS AND METHOD THAT DETECTS A COLOR PATTERN

(75) Inventor: Jun Hosokawa, Tokyo (JP)

(73) Assignee: Ricoh Company, Ltd., Tokyo (JP)

( * ) Notice: Subject to any disclaimer, the term of this patent is extended or adjusted under 35 U.S.C. 154(b) by 1 day.

(21) Appl. No.: 10/462,665

(22) Filed: Jun. 17, 2003

(65) Prior Publication Data

US 2004/0009019 A1 Jan. 15, 2004

(51) Int. Cl.[7] ..... G03G 15/01
(52) U.S. Cl. ..... 399/301; 302/308
(58) Field of Search ..... 399/19, 162, 297, 399/301, 302, 308; 347/115, 116

(56) References Cited

U.S. PATENT DOCUMENTS

| | | | | |
|---|---|---|---|---|
| 4,657,369 | A | 4/1987 | Takeuchi | |
| 6,363,228 | B1 | 3/2002 | Ream | |
| 6,456,310 | B1 * | 9/2002 | Wallace et al. | 347/116 |
| 6,493,011 | B1 * | 12/2002 | Shioya | 347/116 |

OTHER PUBLICATIONS

Patent Abstracts of Japan, JP 2001–312116, Nov. 9, 2001.
Patent Abstracts of Japan, JP 2001–265085, Sep. 28, 2001.

* cited by examiner

*Primary Examiner*—Hoan Tran
(74) *Attorney, Agent, or Firm*—Oblon, Spivak, McClelland, Maier & Neustadt, P.C.

(57) ABSTRACT

A full-color image forming apparatus forms a full-color image using a color-matching pattern of color components formed on an intermediate transfer belt. The image forming apparatus includes at least one pattern detection sensor that detects the color-matching pattern and generates pattern detection signals. A seam mark-detecting sensor detects a seam mark formed on the intermediate transfer belt and generates seam mark detection signals. The seam mark-detecting sensor is aligned with the pattern detection sensor on a same axis extending vertically relative to a traveling direction of the intermediate transfer belt. A memory stores digital signals converted from the pattern detection and seam mark detection signals. A seam mark detection signal deleting device deletes a prescribed seam mark detection signal from the pattern detection signals when the pattern detection signal and the prescribed seam mark detection signal occur simultaneously. A controlling device controls the image forming apparatus in accordance with the pattern detection and seam mark detection signals excluding the prescribed seam mark detection signal.

9 Claims, 5 Drawing Sheets

FIG. 6

| SENSOR 15a Nax | SENSOR 15b Nbx | SENSOR 16 Nc |
|---|---|---|
| 10 | 11 | 0 |
| 30 | 32 | 0 |
| 50 | 51 | 0 |
| 70 | 71 | 0 |
| 75 DELETE | 75 DELETE | 75 DELETE |
| 90 | 91 | 0 |
| . . | . . | . . |
| | | |
| | | |
| | | |

BELT TYPE IMAGE FORMING APPARATUS AND METHOD THAT DETECTS A COLOR PATTERN

CROSS REFERENCE TO RELATED APPLICATION

This document claims priority under 35 U.S.C. §119 to Japanese Patent Application No. 2002-175279 filed on Jun. 17, 2002, the entire contents of which are hereby incorporated herein by reference.

BACKGROUND OF THE INVENTION

1. Field of the Invention

This invention relates to an image forming apparatus such as a copier, a printer, etc., and in particular to an image forming apparatus employing an intermediate transfer belt having a seam, which is capable of suppressing any adverse influence of the seam to obtain a high quality image.

2. Discussion of the Background

In an image forming apparatus such as an optical beam printer a drum type photoconductive member (PC member) is provided to rotate while receiving a scan of a beam having a color component in a main scanning direction in accordance with image data transmitted from either an image reading section or a host computer. Then, latent images are formed with color toner on the PC member and developed to be toner images in accordance with the color component. Subsequently, respective color toner images are transferred and superposed on an intermediate transfer belt one after another, and thereby a full-color image is formed in accordance with the image data.

It has been proposed to utilize a sensor to detect a full-color matching pattern formed on an intermediate transfer belt so that an image formation condition, such as an amount of toner to be supplied or pumped toward a latent image, can be controlled in accordance with data obtained by the sensor, to form a high quality color image in accordance with the image data.

In such a system, an intermediate transfer belt having a ring shape track requires a highly precise peripheral length in a conveyance direction to form a high quality image. Such an intermediate transfer belt is generally formed by connecting leading and trailing ends of a strip-shaped belt in a prescribed peripheral length. Thus, the intermediate transfer belt necessarily includes a seam. As a result, when a usage life exceeds a prescribed level, and accordingly a prescribed time period has elapsed, the intermediate transfer belt needs be replaced with a new one. That is, over time a fixation condition of the seam physically changes, and thereby the peripheral length sometimes deviates beyond an allowable range.

Further, in such a case, when in the background image forming apparatus a color-matching pattern is detected with a sensor, the sensor may erroneously detect a seam mark formed on a seam by regarding the seam mark as the color-matching pattern. Erroneously detecting such a seam mark pattern causes a difficulty in improving a precision of image formation control performed based upon a signal obtained by detecting the color-matching pattern with the sensor.

When an intermediate transfer belt is formed seamless and integral, erroneous detection of the seam mark as a color-matching pattern can be avoided. However, in order to form an intermediate transfer belt to be seamless and integral, complex manufacturing steps are generally needed, and thereby a manufacturing cost increases as a drawback.

SUMMARY OF THE INVENTION

The present invention has been made in view of such problems and to address and resolve such noted problems.

Accordingly, it is an object of the present invention to provide a novel full-color image forming apparatus capable of forming a full-color image using a color-matching pattern of color components formed on an intermediate transfer belt. The image forming apparatus includes at least one pattern detection sensor that detects the color-matching pattern and generates pattern detection signals. A seam mark detecting sensor is provided to detect a seam mark formed on the intermediate transfer belt and to generate seam mark detection signals. The seam mark detecting sensor is aligned with the pattern detection sensor on the same axis extending vertically relative to a traveling direction of the intermediate transfer belt. A memory is provided to store digital signals converted from the pattern detection and seam mark detection signals. A seam mark detection signal deleting device is provided to delete a prescribed seam mark detection signal from the pattern detection signals when the pattern detection signal and the prescribed seam mark detection signal occur substantially simultaneously. A controlling device is provided to control the image forming apparatus in accordance with the pattern detection and seam mark detection signals excluding the prescribed seam mark detection signal.

In another embodiment, an advance notice mode setting device is provided to set an advance notice mode indicating a necessity to replace a used transfer belt with a new one.

In yet another embodiment, an advance notice time setting device is provided to set an advance notice time when an advance notice indicating a necessity to replace a used transfer belt with a new one is displayed.

BRIEF DESCRIPTION OF THE DRAWINGS

A more complete appreciation of the present invention and many of the attendant advantages thereof will be readily obtained as the same becomes better understood by reference to the following detailed description when considered in connection with the accompanying drawings, wherein:

FIG. 6 is a table illustrating sampling numbers counted when the signal level reaches reference levels.

DESCRIPTION OF THE PREFERRED EMBODIMENTS

Figure 1:
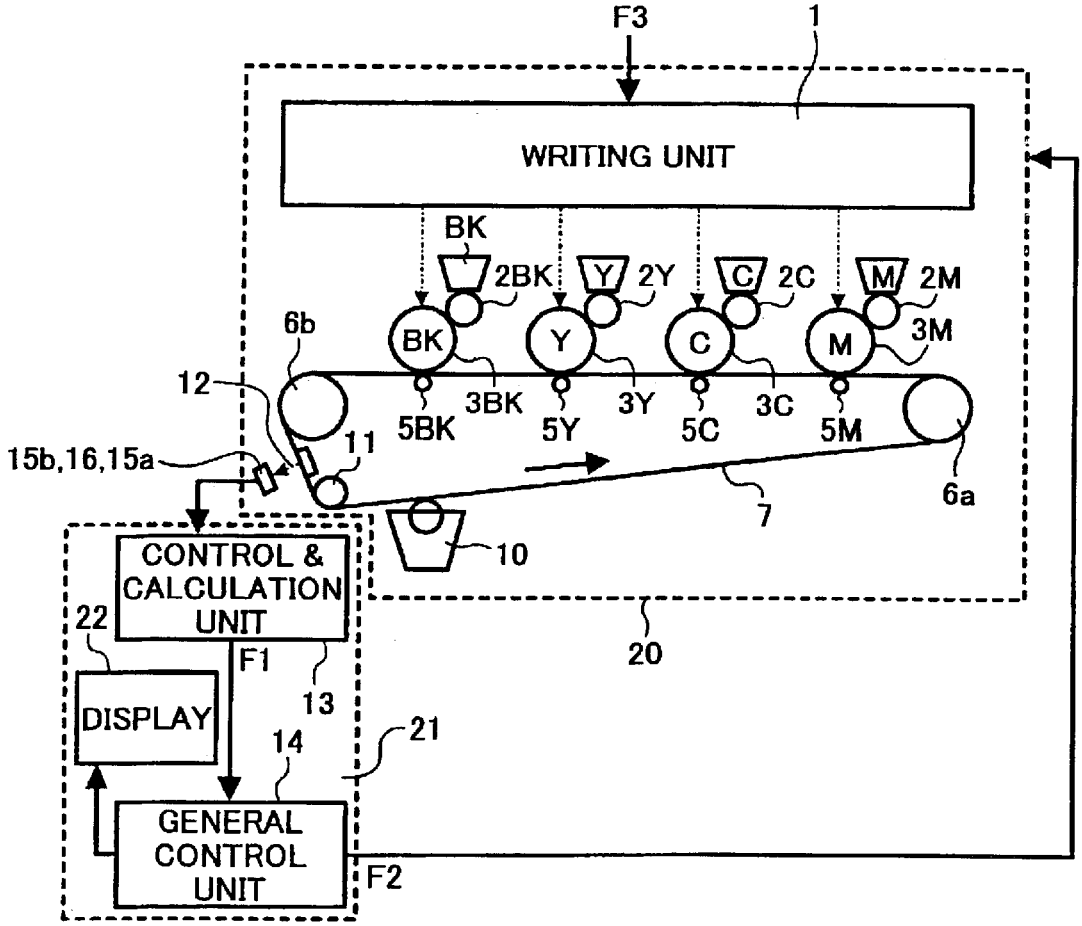
FIG. 1 is a block chart illustrating one example of an image forming apparatus according to the present invention.

Referring now to the drawings, wherein like reference numerals designate identical or corresponding parts throughout the several views, and in particular to FIG. 1, one example is provided of an image-forming unit 20 to form a full-color image, according to the present invention.

In FIG. 1, a control unit 21 is provided to control the image-forming unit 20 to operate. A writing unit 1 is arranged in the image-forming unit 20 to receive an input of image data F3 transmitted from either an image reading section or a host computer. A photo-sensitive drum (PC drum) 3M is also arranged below the writing unit 1 to form a latent image of magenta in accordance with color separation data of magenta included in the image data F3. Similarly, photo-sensitive drums 3C, 3Y and 3BK are arranged below the writing unit 1 to form latent images of cyan, yellow, and black in accordance with cyan, yellow, and black color separation data included in the image data F3, respectively. A plurality of developing devices 2M, 2C, 2Y, and 2BK are arranged in the vicinity of the respective PC drums 3M, 3C, 3Y, and 3BK to develop the latent images formed thereon to be visible images of M, C, Y, and BK.

Further, a transfer belt 7 is arranged in the image forming unit 20 in contact with the respective PC drums 3M, 3C, 3Y, and 3BK and is rotated by a pair of driven rollers 6*a* and 6*b* and a guiding roller 11. On the opposite side to the respective PC drums 3M, 3C, 3Y, and 3BK of the transfer belt 7, a plurality of transfer devices 5M, 5C, 5Y, and 5BK are arranged to transfer respective M, C, Y, and BK visible images on the PC drums 3M, 3C, 3Y, and 3BK to the transfer belt 7 one after another. A detection sensor unit 12 is arranged to detect a seam mark and full-color-matching patterns formed on the transfer belt 7.

Figure 2:
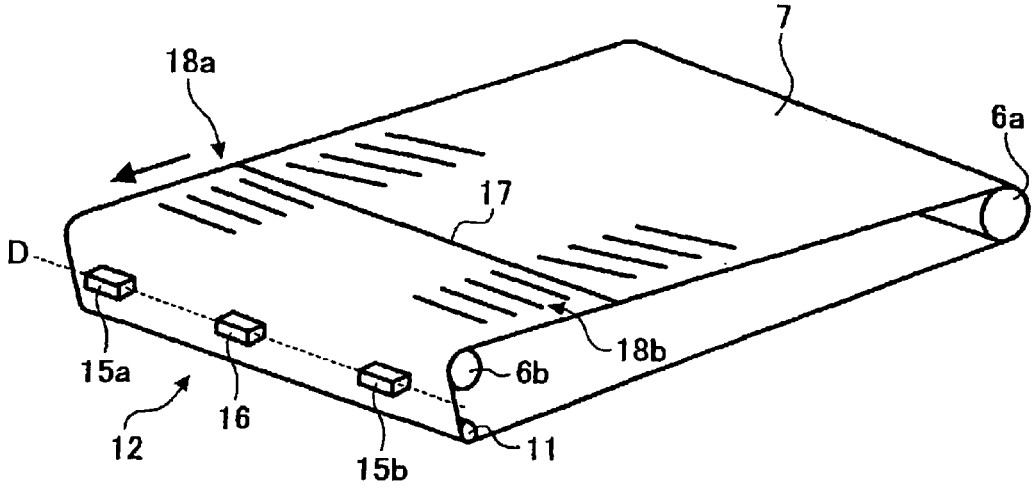
FIG. 2 is a perspective view illustrating a transfer belt having color matching patterns and a plurality of detection sensors illustrated in FIG. 1.
Figure 3:
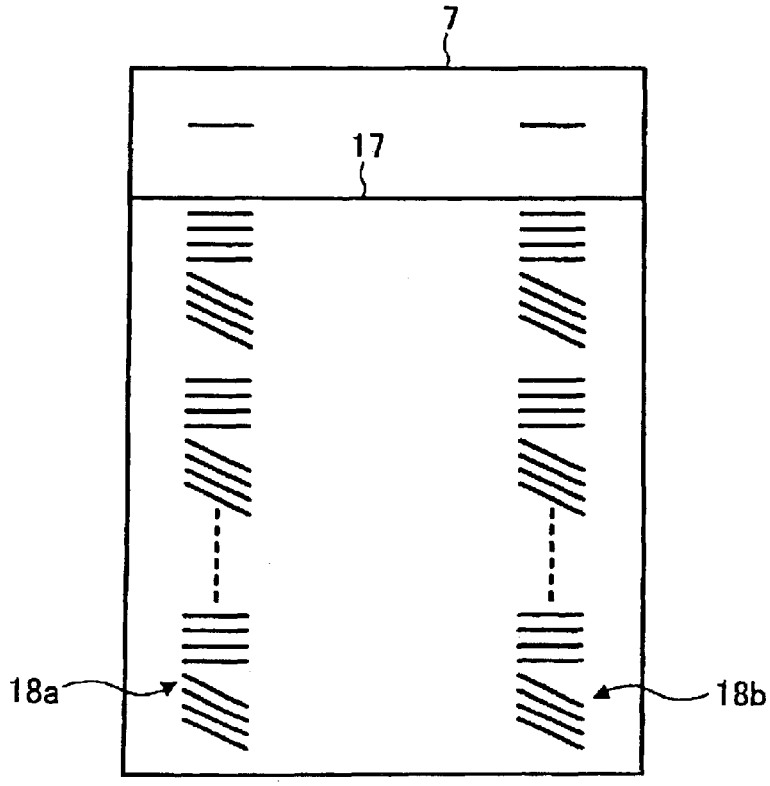
FIG. 3 is an explanatory chart illustrating an arrangement of the color-matching patterns and a seam mark transferred and formed on the transfer belt of FIG. 1.

As illustrated in FIG. 2, the detection sensor unit 12 includes a pair of pattern detection sensors 15*a* and 15*b* separately arranged apart from each other in the vicinity of the transfer belt 7 on an arrangement line D extending perpendicular to a conveyance direction of the transfer belt 7. Also included is a seam mark detection sensor 16 arranged on the arrangement line D opposing a region excluding the color-matching patterns on the transfer belt 7.

Referring again to FIG. 1, a cleaning unit 10 is arranged in the vicinity of the transfer belt 7 between the guide roller 11 and driven roller 6*a* to clean the transfer belt 7 after completion of an image forming operation. Further, the control unit 21 is connected to an output terminal (not shown) of the detection sensor unit 12. A control calculation unit 13 is also connected to the detection sensor unit 12 to calculate detection signals detected by the detection sensor unit 12 and to output an adjustment signal to control an image forming operation to be adjusted. A general control unit 14 is connected to the control calculation unit 13 to generally control the image forming operation. A display 22 is connected to the general control unit 14 to display various information.

An image formation control signal F2 is input to the image-forming unit 20 from the general control unit 14. Further, the control calculation unit 13 includes a replacement number setting device, which sets a number of seam mark detection signals output from the seam mark detection sensor 16 to determine a replacement time for a new transfer belt 7. A replacement notification-selecting device is also provided to selectively determine if an advance notice of replacement is to be given when a prescribed number of the seam marks is detected, and accordingly, that of the detection signals is counted.

An exemplary operation of the above-mentioned system is now described. The image-forming unit 20 executes an image forming operation in accordance with an image formation control signal F2 input from the general control unit 14 to the image-forming unit 20. Specifically, the pair of driven rollers 6*a* and 6*b* rotates the transfer belt 7 at a prescribed surface speed in a direction shown by an arrow. When the PC drums 3M, 3C, 3Y, and 3BK are rotated clockwise at a same surface speed as that of the transfer belt 7, the writing unit 1 initially extracts and obtains M image data from the image data F3. An optical unit serving as the writing unit 1 formed from a laser, a polygon mirror, f-theta lens, and a reflection mirror writes an image in accordance with the M image data, and thereby a magenta latent image (herein after referred to as an M-latent image) is formed on the PC drum 3M. When the M-latent image passes through the developing unit 2M while the PC drum 3M is rotated, the M-latent image formed on the PC drum 3M is developed by the developing unit 2M with M toner, and thereby a M-visible image is formed thereon. Further, when the M visible image then passes through a transfer roller 2M while the PC drum 3M rotates, the M-visible image is transferred to the transfer belt 7 under influence of a bias voltage impressed onto the transfer roller 5M.

In accordance with the C-image data extracted and obtained from the image data F3, the optical unit 1 forms a cyan latent image (herein after referred to as a C-latent image) on the PC drum 3C with a delay of a prescribed time period from the optical writing for the M-latent image on the PC drum 3M. Subsequently, the C-latent image formed on the PC drum 3C is developed by the developing unit 2C with the C-toner; thereby a C-visible image is formed on the PC drum 3C. In synchronism with the leading end of the C-visible image arriving at a position of the transfer roller 5C, the leading end of the M-visible image on the transfer belt 7 arrives at the transfer position. Then, the C-visible image on the PC drum 3C is sequentially transferred by the transfer roller 5C to overly on the M-visible image on the transfer belt 7, and thereby the M and C-visible images are sequentially formed on the transfer belt 7.

Similarly, the optical unit 1 forms a yellow latent image (herein after referred to as a Y-latent image) on the PC drum 3Y with a delay of a prescribed time. The Y-latent image is then developed by the developing device 2Y with Y toner. The Y visual image is then transferred by the transfer roller 5Y to overly the M and C, visual images conveyed to a transfer position of the transfer roller 5Y. Thereby, the M, C, and Y visual images are sequentially formed and superposed on the transfer belt 7. Then, the optical unit forms a black latent image as a BK-image (herein after referred to as a BK-latent image) on the PC drum 3BK with a delay of a prescribed time period. The BK-latent image is then developed by the developing device 2BK with BK toner. The BK visual image is then transferred by the transfer roller 5BK to overly the M, C, and BK visual images conveyed to a position of the transfer roller 5BK. Thereby, the M, C, Y, and BK visual images are sequentially formed and superposed on the transfer belt 7.

Thus, a full-color image of the M, C, Y, and BK visual images is formed on the transfer belt 7 in accordance with the image data F3. The full-color image is then transferred at once to a transfer sheet (not shown) in the vicinity of the guiding roller 11 from the transfer belt 7. The full-color image then receives a fixing process in accordance with the image data, and thereby the full-color image forming process is completed.

Beside the full-color image forming process, a plurality of full-color matching patterns 18*a* and 18*b* each having M, C, Y, and BK visual images for color offset adjustment use are periodically or optionally formed on the PC member in accordance with prescribed instructions. The full-color matching patterns 18*a* and 18*b* are then transferred to both end sides of the transfer belt 7. A seam mark 17 is unavoidably formed at a seam of the transfer belt 7 to be detected by the seam detection sensor 16.

Figure 5:
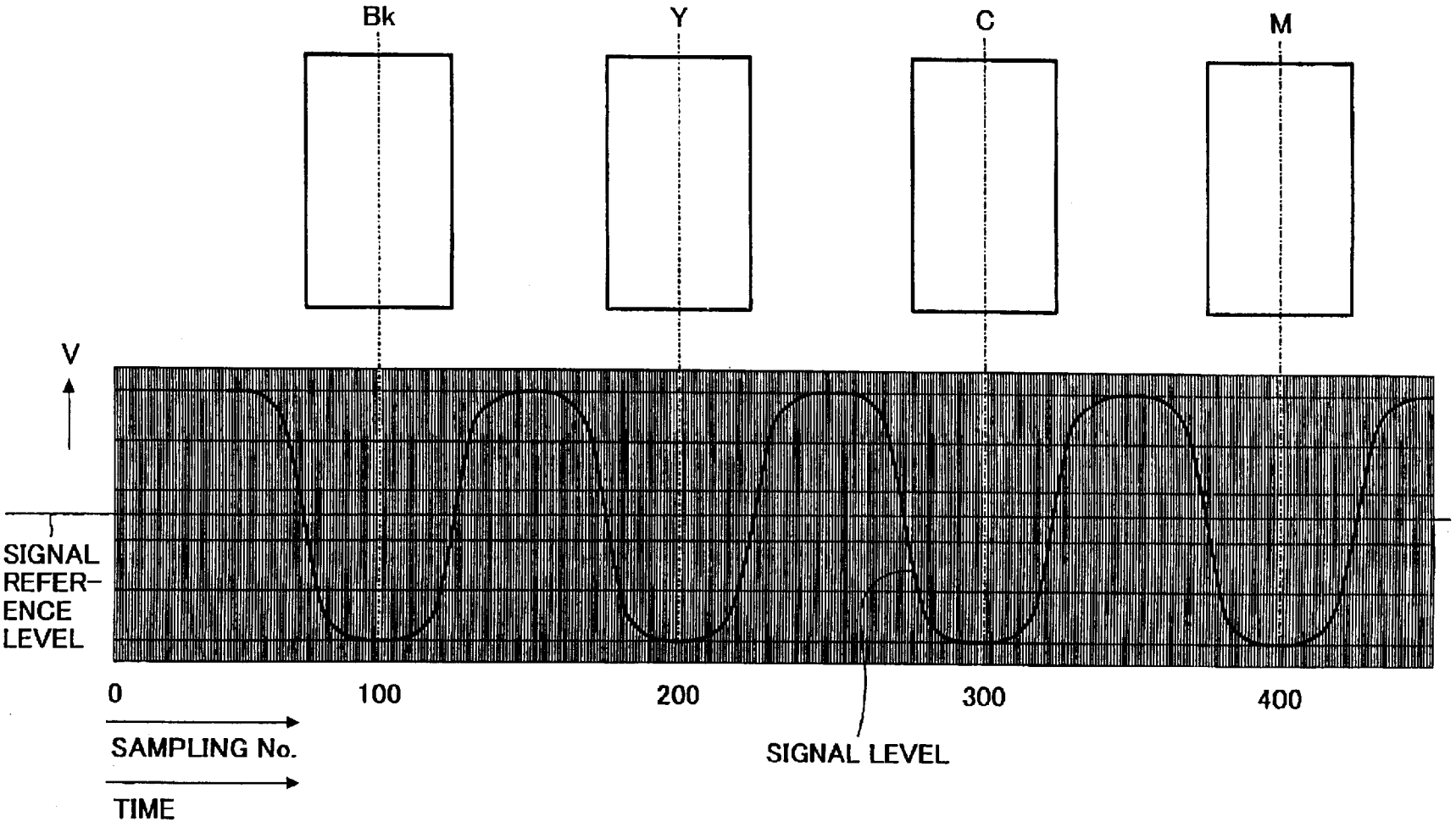
FIG. 5 is a chart illustrating a signal level obtained by detecting the color patterns with the detection sensor in relation to a sampling number.

As illustrated in FIG. 2, the pattern detection sensors 15*a* and 15*b* are separately arranged from each other in the vicinity of the transfer belt 7 on the arrangement line D drawn perpendicular to the conveyance direction of the transfer belt 7. Specifically, the pattern detection sensors 15*a* and 15*b* are positioned downstream of the transfer positions for the full-color matching patterns 18*a* and 18*b* on the transfer belt 7. These pattern detection sensors 15*a* and 15*b* detect the full-color matching patterns 18*a* and 18*b*, respectively, as illustrated in FIG. 5. The seam mark detection sensor 16 is also arranged on the arrangement line D opposing a region of the transfer belt 7 other than where the color-matching patterns 18*a*, 18*b* are formed.

Detection signals continuously output from the pattern detection sensors 15*a* and 15*b* are sampled at a prescribed frequency and input to the control calculation unit 13 and receive AID conversion into digital signals (i.e., voltage values) one after another. The digital signals are sequentially stored in a memory (not shown) provided in the control calculation unit 13.

Specifically, the control calculation unit 13 may execute an A/D conversion process by converting the detection signal as an analog signal into a digital signal using, e.g., a conventional saw tooth state wave signal and reference clock, which reference clock determines a frequency of sampling. The control calculation unit 13 may then count a number of reference clocks (i.e., sampling clocks) until the detection signal arrives at the reference signal level as illustrated in FIG. 5 as a first count value. The reference signal level is set in proportion to a normal density of a pattern, for example. A number of reference clocks is subsequently calculated by the control calculation unit 13 after the detection signal arrives and decreases from the reference signal level until the detection signal arrives again at the reference signal level as a second count value. The control calculation unit 13 may add half a difference between the first and second count values to the first count value to obtain a center of the first and second count values to determine a central position within a mark. The control calculation unit 13 may then store the thus counted values in the memory as a center positional information of the detected mark in the pattern one after another.

The seam mark detection signal output from the seam mark detection sensor 16 also receives similar A/D conversion, clock number counting, and positional information calculation, and storage as performed for the pattern detection signals from the control calculation unit 13.

Then, the control calculation unit 13 may generate a series of count values Na1 to Nan in correspondence with the Bk, Y, C, and M pattern mark positions detected by the pattern detection sensor 15*a*. The control calculation unit 13 may also generate a count value Nc in correspondence with the seam mark position detected by the seam mark detection sensor 16.

Then, the below described calculation is performed wherein legend "A" represents a prescribed approximation judgment value:

$$-A<Nax-Nc<A \ (x=1\cdot 2 \ldots n) \quad (1)$$

Similarly, a series of count values Nb1 to Nbn are generated in correspondence with the Bk, Y, C, and M pattern mark positions detected by the pattern detection sensor 15*b*, and the below described calculation is similarly performed:

$$-A<Nbx-Nc<A \ (x=1\cdot 2 \ldots n) \quad (2)$$

Then, where Nax and Nbx simultaneously meet these formulas (1) and (2) are determined and deleted from the memory by regarding that the seam mark is improperly detected by the pattern detection sensors 15*a* and 15*b* as a part of the pattern mark as illustrated in FIG. 6. Specifically, these approximate control values are highly provably obtained from the seam 17 making a right angle with the traveling direction of the transfer belt 7. As a result, only count values corresponding to the actually formed patterns 18*a*, 18*b* can be stored in the memory while excluding the count value corresponding to the seam mark 17 detected by the pattern detection sensors 15*a* and 15*b*.

Then, the control calculation unit 13 calculates an adjustment signal F1 adjusting and controlling the image forming apparatus to operate in accordance with the count values corresponding to full-color matching patterns while excluding erroneous detection signals. The adjustment signal F1 is then output from the control calculation unit 13 to the general control unit 14. The general control unit 14 generates an image formation control signal F2 controlling the image-forming unit 20 to form an image in accordance with the adjustment signal F1. The image formation control signal F2 is input to the image forming unit 20. The image-forming unit 20 performs an image-forming operation in accordance with the image formation control signal F2.

Thus, the image forming unit 20 precisely adjusts an amount of toner supplied to developing units 2M, 2C, 2Y, and 2BK, bias voltages impressed to the transfer rollers 5M, 5C, 5Y, and 5BK, color offset, or the like, in accordance with the detection signals of the full-color matching patterns. As a result, a high quality image is always formed in accordance with the image data F3.

Figure 4:
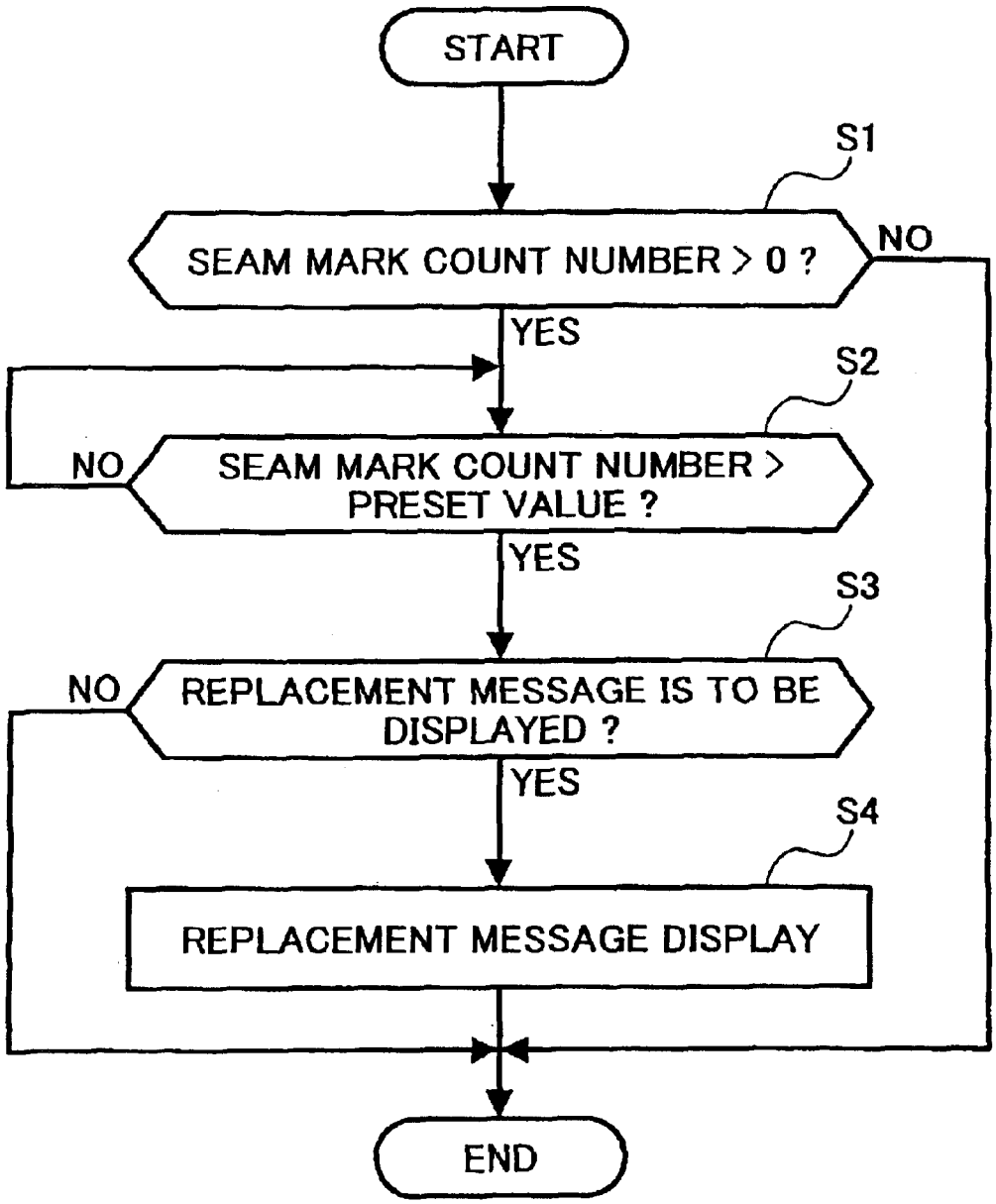
FIG. 4 is a flowchart illustrating an advance notifying operation for indicating a necessity to replace a currently used transfer belt with a new transfer belt.

An operation of an advance notice mode notifying the necessity of replacement of a currently used transfer belt is now described with reference to FIG. 4. As shown in FIG. 4, the count value Nc corresponding to the seam mark detection signals generated by the seam mark detection sensor 16 is stored in the memory, as mentioned earlier, in step S1. If it is determined that the transfer belt 7 includes a seam 17, the process goes to step S2. Then, it is determined if the count value Nc exceeds a prescribed setting value. If the prescribed setting value is determined as positive, YES in step S2, the process goes to step S3. It is then determined if the advance notice mode is set. If the determination is determined as YES in step S3, the process goes to step S4. Messages indicating the need to replace the current transfer belt 7 are then displayed on a display 22 by the general control unit 14 in response to an instruction from the control calculation unit 13.

Thus, when a user selectively sets the advance notice mode to the control calculation unit 13, a usage life of the transfer belt 7 is checked in accordance with a number of detections of the seam mark 17 and the replacement, i.e. the need to replace the current transfer belt 7, status is displayed at a prescribed time as mentioned above. As a result, a high quality image is continuously formed while appropriately replacing a used transfer belt 7 with a new one in accordance with an operational condition of the image forming apparatus.

In contrast, if the user does not select the advance notice mode, the transfer belt 7 is periodically replaced at a prescribed interval.

Mechanisms and processes set forth in the present invention may be implemented using one or more conventional general-purpose microprocessors and/or signal processors programmed according to the teachings in the present specification as will be appreciated by those skilled in the relevant arts. Appropriate software coding can readily be prepared by skilled programmers based on the teachings of the present disclosure, as will also be apparent to those skilled in the relevant arts. However, as will be readily apparent to those skilled in the art, the present invention also may be implemented by the preparation of application-specific integrated circuits by interconnecting an appropriate network of conventional component circuits or by a combination thereof with one or more conventional general purpose microprocessors and/or signal processors programmed accordingly. The present invention thus also includes a computer-based product which may be hosted on a storage medium and include, but is not limited to, any type of disk including floppy disks, optical disks, CD-ROMs, magnet-optical disks, ROMs, RAMs, EPROMs, EEPROMs, flash memory, magnetic or optical cards, or any type of media suitable for storing electronic instructions.

Numerous modifications and variations of the present invention are possible in light of the above teachings. It is therefore to be understood that within the scope of the appended claims, the present invention may be practiced otherwise than as specifically described herein.

What is claimed is:

1. An image forming apparatus configured to form a full-color image using a color matching pattern of color components formed on an intermediate transfer belt, said image forming apparatus comprising:

at least one pattern detection sensor configured to detect the color matching pattern and configured to generate pattern detection signals;

a seam mark detecting sensor configured to detect a seam mark formed on the intermediate transfer belt and configured to generate seam mark detection signals, said seam mark detecting sensor being aligned with the pattern detection sensor on a same axis extending vertically relative to a traveling direction of the intermediate transfer belt;

a memory configured to store digital signals converted from the pattern detection signals and the seam mark detection signals;

a seam mark detection signal deleting device configured to delete a prescribed seam mark detection signal from the pattern detection signals when the pattern detection signal and the prescribed seam mark detection signal simultaneously occur; and a control device configured to control the image forming apparatus in accordance with the pattern detection and seam mark detection signals excluding the prescribed seam mark detection signal.

2. The image forming apparatus according to claim 1, further comprising an advance notice mode setting device configured to set an advance notice mode indicating a necessity to replace the intermediate transfer belt with a new intermediate transfer belt.

3. The image forming apparatus according to claim 1, further comprising an advance notice time setting device configured to set an advance notice time when an advance notice of replacement of the intermediate transfer belt is displayed.

4. An image forming apparatus configured to form a full-color image using a color matching pattern of color components formed on an intermediate transfer belt, said image forming apparatus comprising:

at least one pattern detection means for detecting the color matching pattern and for generating pattern detection signals;

seam mark detecting means for detecting a seam mark formed on the intermediate transfer belt and for generating seam mark detection signals, said seam mark detecting means being aligned with the pattern detection means on a same axis extending vertically relative to a traveling direction of the intermediate transfer belt;

storage means for storing digital signals converted from the pattern detection signals and the seam mark detection signals;

seam mark detection signal deleting means for deleting a prescribed seam mark detection signal from the pattern detection signals when the pattern detection signal and the prescribed seam mark detection signal simultaneously occur; and control means for controlling the image forming apparatus in accordance with the pattern detection and seam mark detection signals excluding the prescribed seam mark detection signal.

5. The image forming apparatus according to claim 4, further comprising an advance notice mode setting means for setting an advance notice mode indicating a necessity to replace the intermediate transfer belt with a new intermediate transfer belt.

6. The image forming apparatus according to claim 4, further comprising an advance notice time setting means for setting an advance notice time when an advance notice of replacement of the intermediate transfer belt is displayed.

7. A method for forming a full-color image, comprising:

employing an intermediate transfer belt having a seam;

forming a color-matching pattern of color components on the intermediate transfer belt;

detecting the color matching pattern and generating pattern detection signals using a pattern detection sensor;

aligning a seam mark detecting sensor with the pattern detection sensor on an axis extending vertically relative to a traveling direction of the intermediate transfer belt;

detecting a seam mark formed on the intermediate transfer belt and generating seam mark detection signals using the seam mark detecting sensor;

storing digital signals converted from the pattern detection and seam mark detection signals in a memory;

deleting a prescribed seam mark detection signal from the pattern detection signals when the pattern detection signal and the prescribed seam mark detection signal simultaneously occur; and controlling the image forming apparatus in accordance with the pattern detection excluding the prescribed seam mark detection signal.

8. The method according to claim 7, further comprising:

accepting an input of an advance notice mode; and notifying of a necessity of replacement of the intermediate transfer belt.

9. The method according to claim 7, further comprising:

accepting a setting operation of an advance notice time; and notifying of a necessity of replacement of the intermediate transfer belt when the advance notice time has expired.

* * * * *